US007159863B2

(12) United States Patent
Murrell et al.

(10) Patent No.: US 7,159,863 B2
(45) Date of Patent: Jan. 9, 2007

(54) COMPLIANT MEDIA STACK HEIGHT LIMITER

(75) Inventors: Niko J. Murrell, Lexington, KY (US); Daniel L. Carter, Georgetown, KY (US); Kimberly A. Thuringer, Lexington, KY (US); David Wayne Hunter, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 58 days.

(21) Appl. No.: 10/925,523

(22) Filed: Aug. 25, 2004

(65) Prior Publication Data

US 2006/0043665 A1 Mar. 2, 2006

(51) Int. Cl.
*B65H 7/02* (2006.01)

(52) U.S. Cl. ..... 271/157; 271/145; 271/25

(58) Field of Classification Search ..... 271/145, 271/157, 164, 162, 25, 31, 130, 217, 215
See application file for complete search history.

(56) References Cited

U.S. PATENT DOCUMENTS

| | | | | |
|---|---|---|---|---|
| 3,955,811 | A | 5/1976 | Gibson | |
| 4,635,919 | A | 1/1987 | Habich et al. | |
| 4,832,329 | A | 5/1989 | Rodi et al. | |
| 5,171,007 | A | 12/1992 | Kasprzak et al. | |
| 5,205,550 | A * | 4/1993 | Perino | 271/157 |
| 5,207,416 | A | 5/1993 | Soler | |
| 5,273,271 | A * | 12/1993 | Intemann | 271/145 |
| 5,286,018 | A | 2/1994 | Rasmussen et al. | |
| 5,700,003 | A * | 12/1997 | Sung | 271/110 |
| 5,944,307 | A | 8/1999 | Yim | |
| 5,992,843 | A | 11/1999 | Lee | |
| 6,050,565 | A | 4/2000 | Fetherolf | |
| 6,135,436 | A | 10/2000 | Hur | |
| 6,206,362 | B1 | 3/2001 | Tan et al. | |
| 6,217,018 | B1 | 4/2001 | Tay et al. | |
| 6,409,165 | B1 | 6/2002 | Yamaoka et al. | |
| 6,478,294 | B1 | 11/2002 | Hiratani | |
| 6,592,119 | B1 | 7/2003 | Goldbeck et al. | |

FOREIGN PATENT DOCUMENTS

| | | | |
|---|---|---|---|
| JP | 05116802 A | * | 5/1993 |
| JP | 05186093 A | * | 7/1993 |
| JP | 06100179 A | * | 4/1994 |

* cited by examiner

*Primary Examiner*—Gene O. Crawford
*Assistant Examiner*—Kaitlin Joerger
(74) *Attorney, Agent, or Firm*—Coats and Bennett, PLLC

(57) ABSTRACT

A method and apparatus for limiting the height of media inserted into a media tray of an image forming apparatus 10 while also allowing for the inserted media to expand due to changing environmental conditions is described herein. An exemplary stack height limiting system comprises an elongated arm with a striking end spaced from a control end, where the arm is movable between first and second positions. A limiter positioned relative to the arm defines the first position, where the striking end is spaced from the bottom surface of the tray by a first gap. As media disposed in the tray expands beyond the first gap, the expanding media moves the arm to form a second, greater distance between the striking end and the bottom surface of the tray. As a result, pinch points between the first end and the media are avoided.

37 Claims, 9 Drawing Sheets

COMPLIANT MEDIA STACK HEIGHT LIMITER

BACKGROUND

Printers, copiers, and other image forming apparatuses can print on a variety of media. The input trays of such devices are designed to accommodate various types of media that may vary in size, thickness, weight, moisture content, beam strength, tendency to curl, surface properties, etc.

Image forming apparatuses typically include a media handling system that feeds multiple types of media through the image forming apparatus in a reliable manner. Media handling system failures may cause damaged sheets and machine shutdowns. Such failures may be caused by any number of factors. For example, inserting too much media into the image forming apparatus may disrupt the feeding process of the media handling system. Therefore, the amount of media that is fed into the machine should be controlled.

Conventional image forming apparatuses employ stationary media stack height limiters to prevent an operator from overloading the media tray, and therefore to control the amount of media inserted into the tray. By limiting the height of the media stack, stack height limiters help prevent mis-feeds, multi-feeds, or fail-to-feeds of media into the image forming apparatus. However, while conventional stack height limiters may prevent too much media from being inserted into the media tray, these limiters do not account for height variations in the media due to environmental changes, such as temperature and humidity, which may cause the media in the tray to expand. Even though the stack height was initially limited, swelling caused by these environmental changes may alter the height of the stack, causing the height to become too great to allow smooth handling of media.

When the media stack height increases beyond a desirable limit due to environmental change, stationary stack height limiters may cause a pinch point in the media at the position where the stack height limiter contacts the media. Pinch points lead to mis-feeds and fail-to-feeds of media which bind or jam the image forming apparatus. Problems with feeding the media into the image forming apparatus cause less than optimum machine performance and increase machine downtime. As a result, the increased likelihood of paper jams under certain environmental conditions is a great disadvantage of stationary media stack height limiters.

SUMMARY

The present invention is a method and apparatus for limiting the height of media inserted into an image forming apparatus while also allowing for media expansion due to environmental conditions. An exemplary stack height limiting system according to the present invention comprises an elongated arm with a first end spaced from a second end, where the arm is movable between first and second positions. A limiter positioned relative to the arm defines the first position, wherein in the first position, the first end is oriented at a predefined insertion height to prevent the insertion of excess media. As a result, the first end of the elongated arm is spaced a fixed distance from the bottom surface of a media tray when the stack height limiting system is in the first position.

In an exemplary embodiment, the limiter comprises an extension that extends outwardly from the elongated arm and into an opening comprising first and second boundaries. The extension moves within the opening to enable the elongated arm to move between the first and second positions. When the extension contacts the first boundary, the device is in the first position. As a result, a first gap forms between the first end, also referred to herein as a striking surface, and the bottom surface of the media tray. When in the first position, the striking surface may have a substantially perpendicular orientation relative to the bottom surface of the media tray. As the extension moves within the opening, a second larger gap is formed between the striking end and the bottom surface of the media tray.

An exemplary method according to the present invention comprises inserting a first volume of media into the media tray of an image forming apparatus. While the media is inserted, a controller oriented in a first position prevents the insertion of additional media beyond a second volume that is greater than or equal to the first volume. When the media in the tray expands beyond the second volume, the controller moves to a second position.

Another exemplary method comprises positioning a controller having an elongated shape with first and second ends in a first position such that the distance between the first end and a bottom surface of a media tray defines a first gap. When media is inserted into the tray, the first end of the controller blocks media having a height greater than the first gap to prevent the insertion of media beyond the first gap. Once inserted, the media may expand beyond the first gap due to environmental conditions. In response, the controller moves to a second position based on the media expansion such that the distance between the bottom surface of the tray and the first end defines a second gap larger than the first gap.

DETAILED DESCRIPTION

The present invention is directed towards movable stack height limiters that account for height variations in media disposed in a media tray of an image forming apparatus. As used herein, an image forming apparatus or device may be any device that transfers an image onto media fed through the device. Such devices include, but are not limited to, printers, copiers, and facsimile machines.

Figure 1:
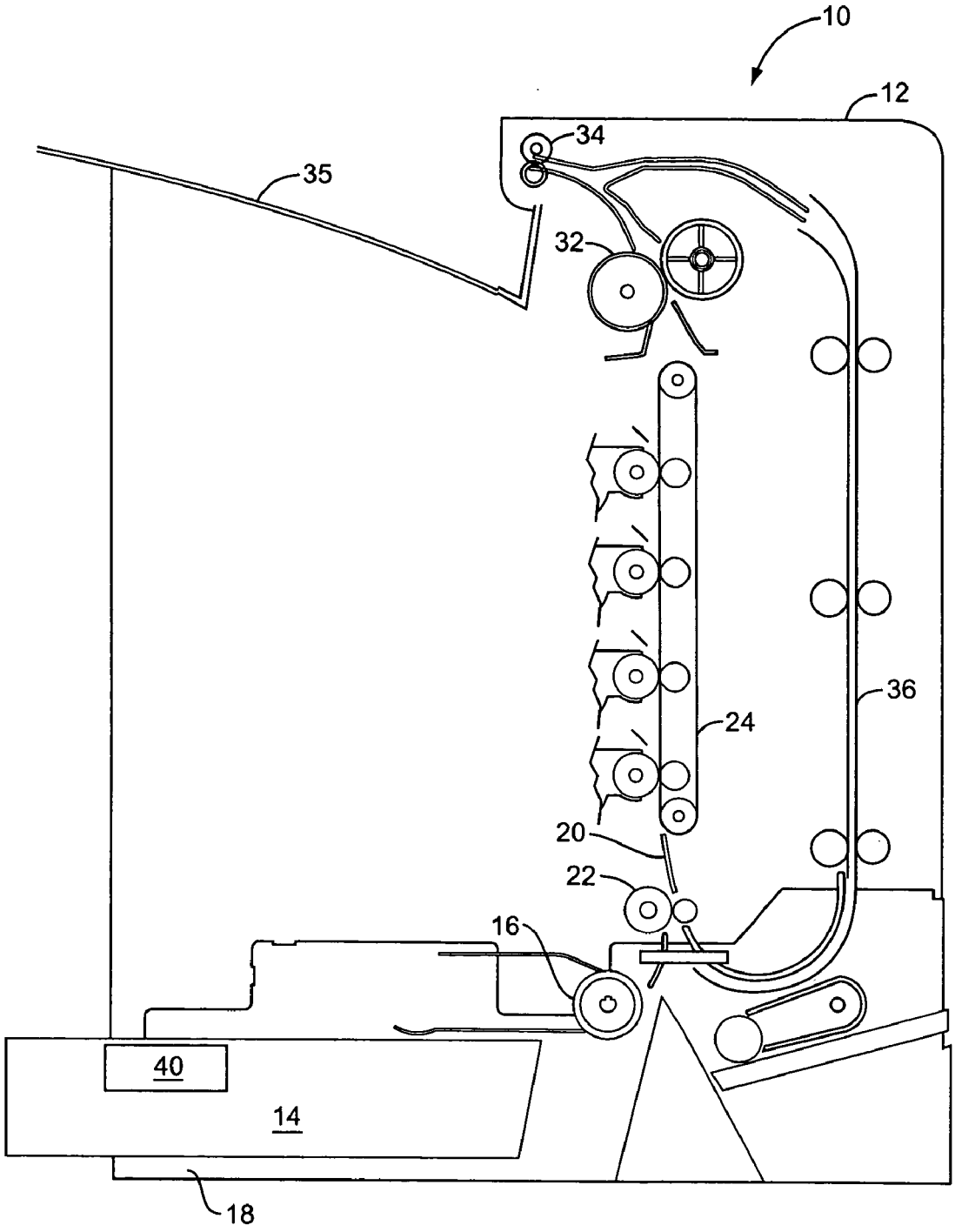
FIG. 1 illustrates a schematic side view of an image forming apparatus according to one embodiment of the present invention.
Figure 2:
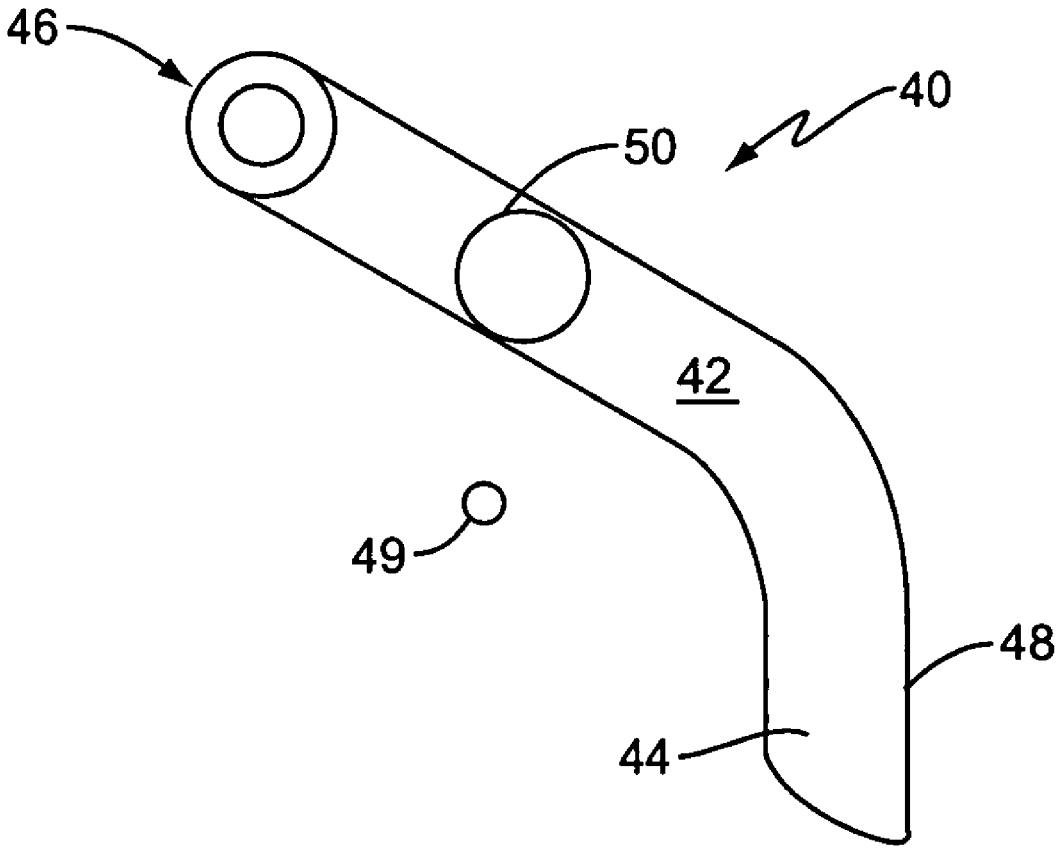
FIG. 2 illustrates a schematic side view of an exemplary media controller according to one embodiment of the present invention.
Figure 3A:
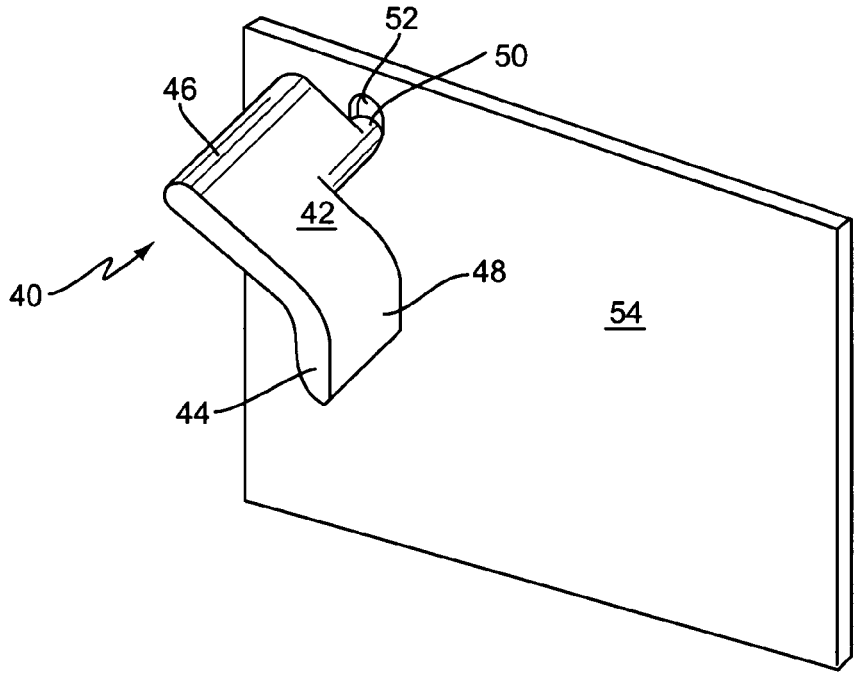
FIG. 3A is a partial perspective view from a first side illustrating the exemplary media controller of FIG. 2 secured to the image forming apparatus.
Figure 3B:
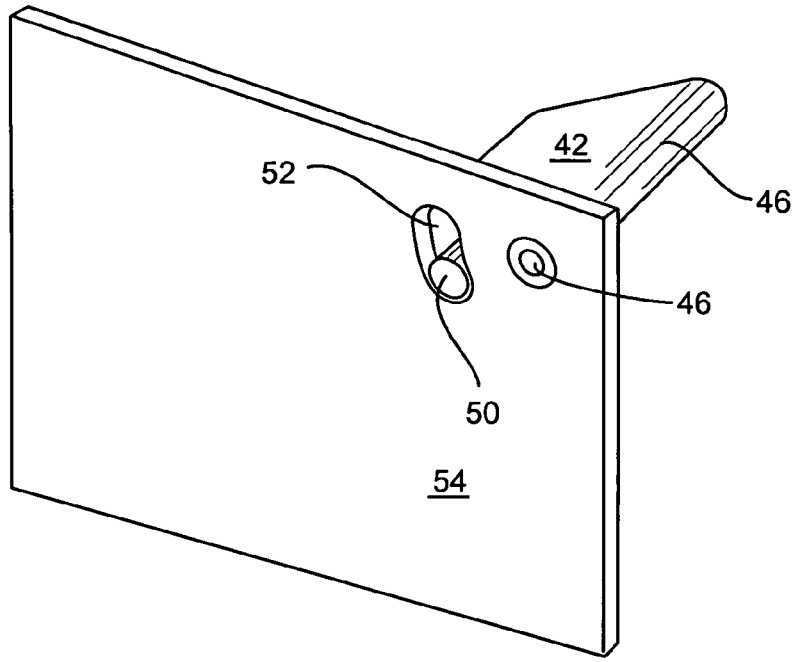
FIG. 3B is a partial perspective view from a second side illustrating the exemplary media controller of FIG. 3A secured to the image forming apparatus.

FIG. 1 depicts an exemplary image forming apparatus, such as a printer, indicated generally by the numeral 10. An input section of the main body 12 includes a media tray 14 with a pick mechanism 16 to introduce media disposed in the media tray 14 into the media path 20. The media tray 14 fits within an input cavity 18 of the image forming apparatus 10. Further, the media tray 14 may be removable for refilling, and located on a lower section of the image forming apparatus 10. When inserted into the cavity 18, a stack height limiting system 40 associated with the media tray 14 controls the height of the media inserted into the tray 14 as discussed further below.

Media sheets are fed into the media path 20 using one or more registration rollers 22 disposed along the media path 20 to align the media sheet and precisely control its further movement. A media transport belt 24 forms a section of the media path 20 for moving the media sheets past a plurality of image forming units (not shown) to form an image on the media sheet. As the media moves past the image forming units, an imaging device (not shown) forms an electrical charge on a photoconductive member within the image forming units as part of the image formation process, as is well understood in the art. The media sheet with loose toner is then moved through a fuser 32 that adheres the toner to the media sheet. Exit rollers 34 rotate in a forward direction to move the media sheet to an output tray 35, or rollers 34 rotate in a reverse direction to move the media sheet to a duplex path 36. The duplex path 36 directs the inverted media sheet back through the image formation process for forming an image on a second side of the media sheet. Examples of image forming devices having a similar structure include Model Nos. C750 and C752 both available from Lexmark International, Inc. of Lexington, Ky.

As shown in FIG. 1, the input section of the image forming apparatus 10 includes a stack height limiting system 40 proximate the top of the media tray 14 and/or input cavity 18. In exemplary embodiments, the bottom surface of the media tray is stationary relative to the media tray 14. However, it will be appreciated that the stack height limiting system 40 described herein may also be used with media trays having movable bottom surfaces. Broadly, the stack height limiting system 40 of the present invention is a movable device that limits the height of the media inserted into the media tray 14 to an insertion height and allows the media disposed in the media tray 14 to expand beyond the insertion height without causing pinch points between the media and the stack height limiting system 40. As used herein, the phrases "insertion height" or "media insertion height" refers to a predefined height of media that may be inserted into the media tray 14.

FIGS. 2, 3A–B, 4, and 5 illustrate an exemplary stack height limiting system 40 comprising an elongated arm 42 having a striking end 44 that includes a blocking surface 48, a control end 46 spaced from and opposite the striking end 44, and an extension 50 extending from the elongated arm 42 and disposed between the striking end 44 and the control end 46. The stack height limiting system 40 extends from a wall 54 into the media tray 14. In an exemplary embodiment, the stack height limiting system 40 extends between 25 and 30 mm from wall 54 for edge driven image forming apparatuses 10, where media disposed in the media tray 14 aligns with a predefined edge. For center driven devices 10 that align all media disposed in the media tray 14 with a centerline of the image forming apparatus 10, the stack height limiting system 40 may extend further from wall 54 to generally align with the centerline of the image forming apparatus 10. In one embodiment, wall 54 may comprise an interior sidewall of the input cavity 18 in the image forming apparatus 10. Alternatively, wall 54 may comprise a sidewall of the media tray 14.

Figure 4:
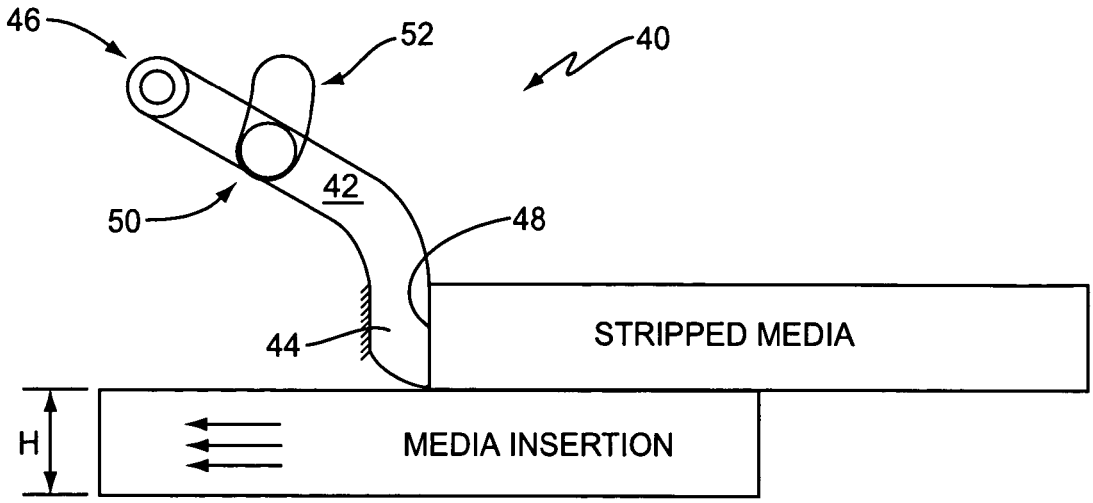
FIG. 4 is a schematic side view illustrating a blocking operation of the exemplary media controller of FIGS. 2, 3A, and 3B according to one embodiment of the present invention.
Figure 5:
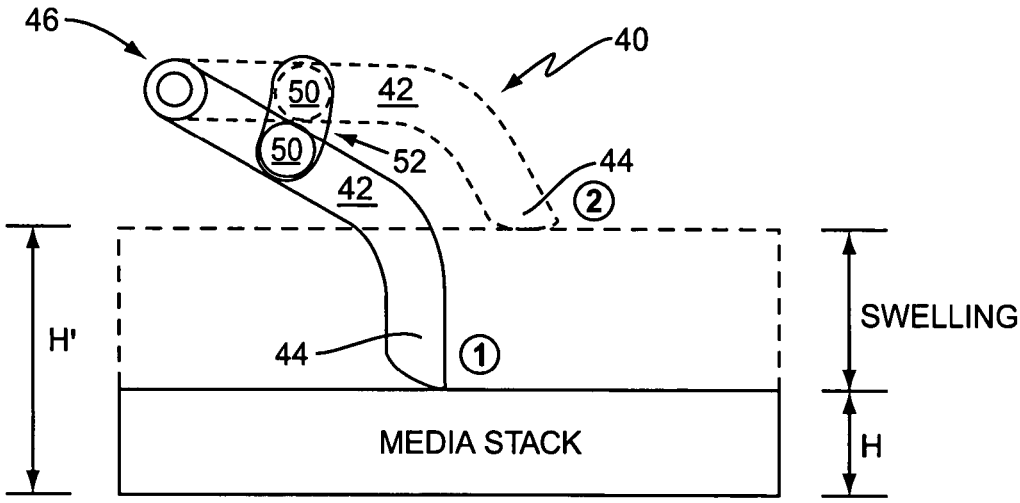
FIG. 5 is a schematic side view illustrating an expansion operation of the exemplary media controller of FIGS. 2, 3A, and 3B according to one embodiment of the present invention.

In any event, extension 50 fits within an opening 52 disposed in the wall 54, while control end 46 operates as a pivot point that is pivotally secured to the wall 54. As shown in FIGS. 4 and 5, opening 52 and extension 50 allow arm 42 to rotate about control end 46 to enable the arm 42 to move between a limiting position (FIG. 4 and position 1 in FIG. 5) and an expansion position (position 2 in FIG. 5). As such, opening 52 defines the boundaries of the limiting and expansion positions associated with the stack height limiting system 40, while extension 50 operates as a limiter to limit the movement of the arm 42 about control end 46.

Figure 6A:
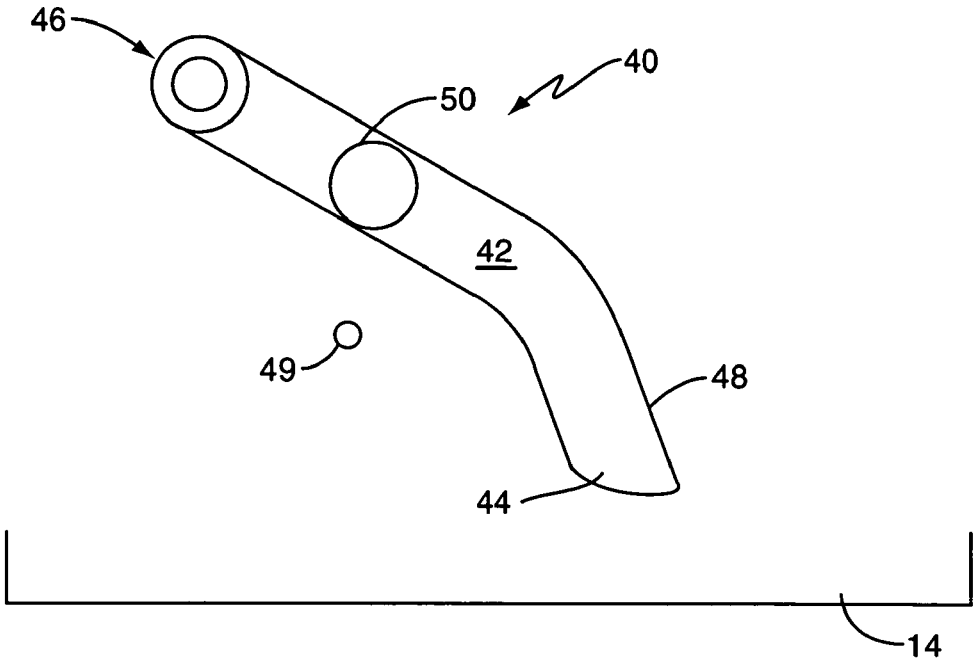
FIGS. 6A and 6B illustrate a schematic side view of another exemplary media controller according to one embodiment of the present invention.
Figure 6B:
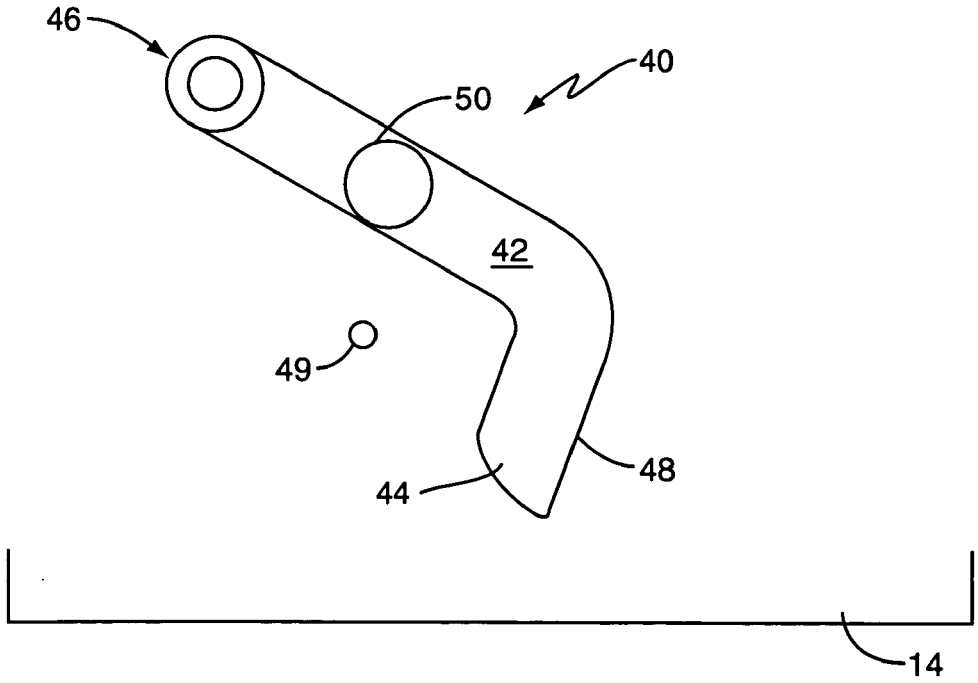

The arm 42 of the stack height limiting system 40 is biased towards the limiting position. In one embodiment, the system 40 has an offset center of gravity, generally referred to herein with reference number 49, to bias the arm 42 towards the limiting position. Further, extension 50 rests against the bottom or limiting edge of opening 52 forming a gap between the bottom of the media tray 14 and the striking end 44. This gap is equal to the amount of media that can be inserted into the input tray 14, referred to as height H as illustrated in FIG. 5. As shown in FIG. 4, when arm 42 is in the limiting position, the blocking surface 48 forms a barrier to prevent excess media from being inserted. The leading edge of excess media greater than a height H that contacts the blocking surface 48 is prevented from being inserted into the tray 14. The blocking surface 48 may be positioned at a variety of angles when the arm 42 is in the limiting position. In one embodiment, the blocking surface 48 is generally perpendicular to the media, and therefore, is substantially perpendicular to the bottom of the media tray 14. However, the blocking surface 48 may also be at various other angles to function as a barrier to prevent excess media from being inserted into the tray 14, as shown in FIGS. 6A and 6B.

As discussed above, media disposed in the tray 14 may expand and contract due to changes in environmental conditions, such as temperature, humidity, etc. The present invention prevents pinch points from forming between the media and the stack height limiter by enabling the arm 42 to adjust along with the changing height of the media in the media tray 14. In so doing, the present invention may also prevent pinch points between the media and pick mechanism 16, which may prevent pick defects. To that end, when the media height swells beyond the predetermined insertion height H, the media stack pushes upwardly on striking end 44, causing extension 50 to move within opening 52, while the arm 42 rotates about pivot end 46, as shown in FIG. 5. As the media expands and contracts in response to the changing environmental conditions, the striking end 44 moves along with the media to prevent pinch points between the media and the stack height limiting system 40. However, it will be appreciated that when the media contracts to a height less than the insertion height H, arm 42 stays in the limiting position such that the striking end 44 no longer contacts the top of the media stack.

Figure 7:
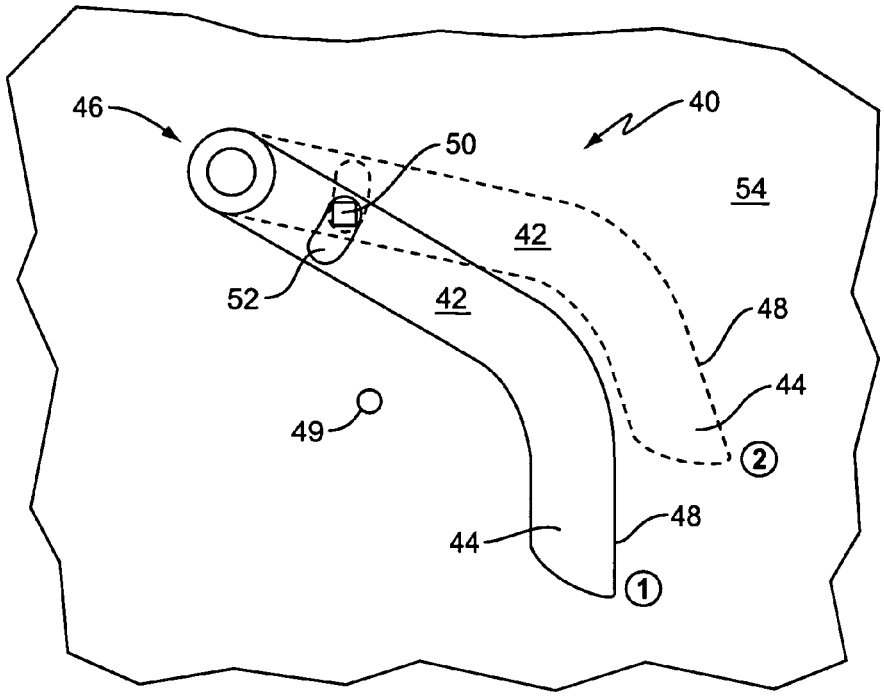
FIG. 7 illustrates a schematic side view of another exemplary media controller according to another embodiment of the present invention.

In the embodiments of FIGS. 2, 3A–B, 4 and 5, the elongated arm 42 of the stack height limiting system 40 includes the extension 50, while wall 54 includes the opening 52. However, the present invention is not so limited. For example, as shown in FIG. 7, wall 54 may include an extension 50 that fits within an opening 52 disposed in the elongated arm 42. In this embodiment, the upper edge of the opening 52 forms the boundary for the limiting position (position 1), while the lower edge of the opening 52 forms the boundary for the expansion position (position 2).

In addition, it will be appreciated that stack height limiting systems 40 having different shapes and/or limiters may be implemented according to the present invention. For example, extension 50 may be a rod having a cylindrical shape that extends from arm 42 into a curved opening, as shown in FIGS. 4 and 5. Alternatively, extension 50 may have a rectangular shape (FIG. 7), a diamond shape (FIGS. 8A and 8B), or any other desired shape. It will be understood that opening 52 will be designed to accommodate the size and shape of the extension 50.

Figure 8A:
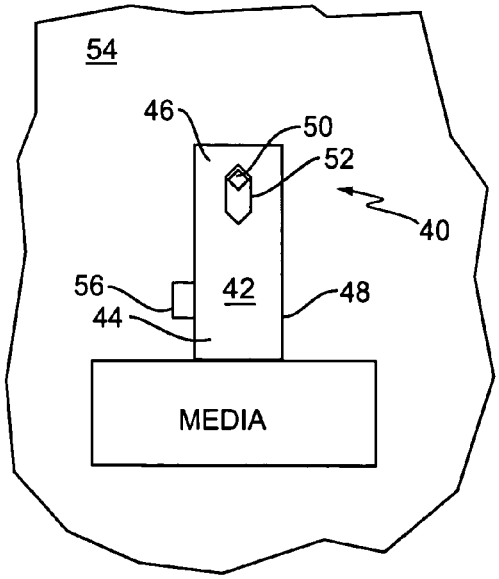
FIGS. 8A and 8B illustrate schematic side views of another exemplary media controller according to one embodiment of the present invention.
Figure 8B:
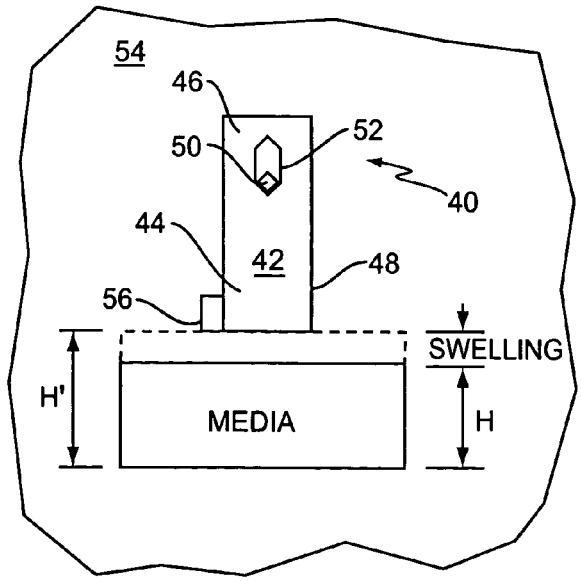

Further, as shown in FIGS. 8A and 8B, stack height limiting system 40 may comprise an arm 42 having a rigid rectangular or other shaped block that extends from wall 54 into media tray 14. As with the above described embodiments, the illustrated stack height limiting system 40 includes an arm 42 with a striking end 44 having a blocking surface 48, a control end 46, and an opening 52, where an extension 50 extending from the wall 54 fits within opening 52. In this embodiment, gravity predisposes the arm 42 towards the first position, where extension 50 abuts the upper edge of opening 52. As discussed above, extension 50 may be any desired shape or size. To prevent the elongated arm 42 from moving in the direction of the media insertion when media is being inserted into the media tray 14, the embodiment of FIGS. 8A and 8B may include some type of horizontal movement control, such as an additional limiter 56. Alternatively, opening 52 may be expanded (not shown) along the length of the elongated arm 42 to receive a rigid plate extending from wall 54 to prevent the arm 42 from moving in the media insertion direction. In this embodiment, the length of the rigid plate would be less than the length of the opening 52 to allow vertical movement. The elongated arm 42 may alternatively be placed in a notch in wall 54 that prevents the horizontal movement but allows vertical movement. In any event, because the arm 42 cannot move in the direction of the media insertion, the blocking surface 48 prevents media with a height exceeding the predetermined insertion height H from being inserted in the media tray 14 when the arm 42 is positioned in the limiting position (FIG. 8A). As the media swells due to changes in the environmental conditions, the media pushes upwardly on the striking end 44, causing the arm 42 to move upwardly, which moves opening 52 upwardly with respect to rod 50.

In the embodiments of FIGS. 2, 3A–3B, 4–5, 6A–6B, and 8A–8B, the range of motion available to the arm 42 is defined by the opening 52 and extension 50, where one edge of the opening 52 defines a boundary of the expansion position, and another opposite edge defines a boundary of the limiting position. As such, opening 52 enables the media to swell beyond a predetermined insertion height H (position 1) to a predetermined expansion height H' (position 2), where the height H' is predetermined such that a pinch point is not caused between the media and the stack height limiting system 40. It will be appreciated that the size of the opening 52 and extension 50 is generally selected based on the expected amount of swelling associated with a wide range of media types and a wide range of environmental conditions. In exemplary embodiments, opening 52 and extension 50 may be sized so that the difference between the expansion height H' and the insertion height H has a range between 0 and 20 mm. While these figures only illustrate the arm position at these extreme boundaries, it will be appreciated that arm 42 may move freely to any position between the limiting and expansion boundary positions.

The above describes a stack height limiting system 40 that includes an opening 52 and an extension 50 to define the boundaries of the limiting and expansion positions. However, the present invention is not limited to these types of stack height limiting systems 40. Spring loaded stack height limiting systems 40 may also be used, as illustrated in FIGS. 9, 10A–10B, 11, and 12.

Figure 9:
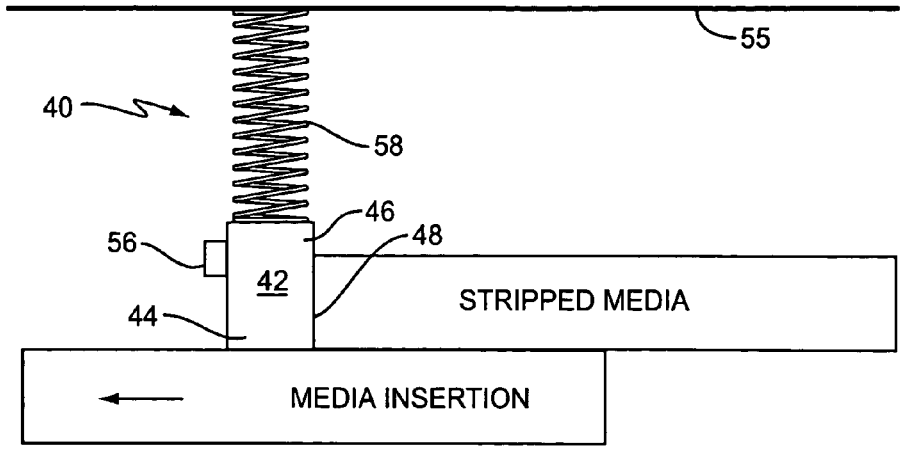
FIG. 9 illustrates a schematic side view illustrating a blocking operation of another exemplary embodiment of a media controller according to one embodiment of the present invention.
Figure 10A:
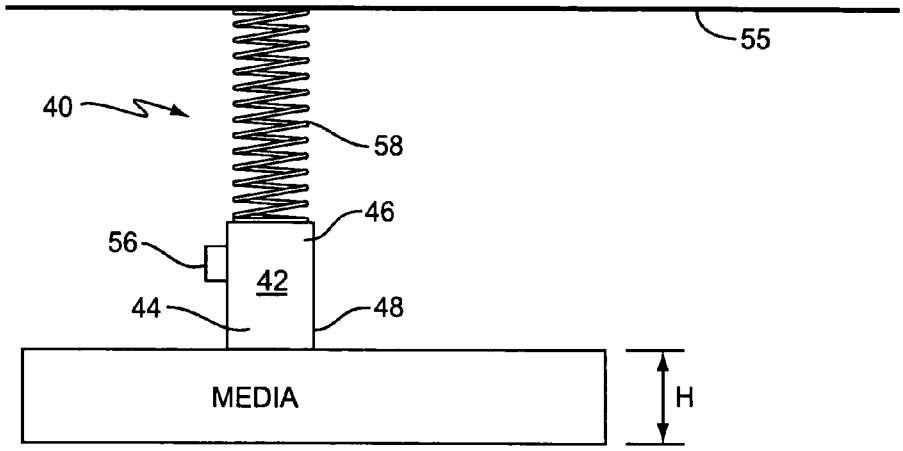
FIGS. 10A and 10B are schematic side views illustrating an expansion operation of the media controller of FIG. 9.
Figure 10B:
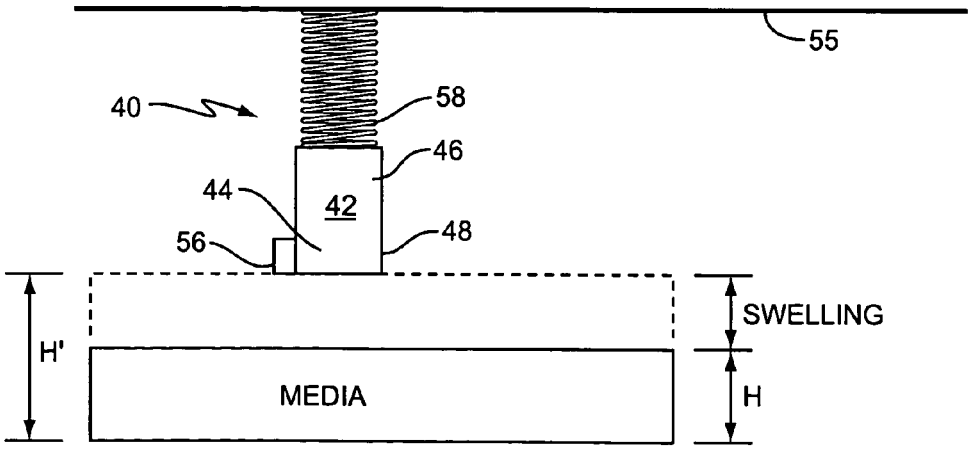

For example, FIGS. 9 and 10A–10B illustrate a spring loaded stack height limiting system 40 having an elongated arm 42 with a striking end 44, a control end 46 opposite the striking end 44, and a blocking surface 48 relative to the bottom of the media tray 14. The stack height limiting system 40 also includes a spring 58 positioned between the control end 46 and an inner ceiling 55 associated with the image forming apparatus 10. The inner ceiling 55 may be part of the input tray 14, or may be within the cavity 18 of the image forming apparatus body 12.

As media is inserted into the media tray 14, blocking surface 48 blocks media exceeding the predetermined insertion height H from being inserted into media tray 14. To prevent unnecessary strain on spring 58 and/or to prevent the excess media from moving the elongated arm 42 in the direction of the media insertion, the illustrated stack height limiting system 40 may include a limiter 56 extending from either a sidewall of the media tray 14 or an interior sidewall of the media tray cavity 18. Further, when the height of the media disposed in the media tray 14 exceeds the predetermined insertion height H, the media pushes upwardly on the striking end 44, causing spring 58 to compress to accommodate the changing height of the media. In this embodiment, the maximum compression and the maximum expansion of spring 58 may define the boundaries of the limiting position (FIG. 10A) and the expanding positions (FIG. 10B), respectively. Further, as discussed above, when the media height is less than the maximum insertion height H, spring 58 maintains the elongated arm 42 in the first position, causing the media to separate from the arm 42. Alternatively in the embodiments of FIGS. 9 and 10A–10B, mechanical limiting mechanisms may be positioned at the maximum and minimum points to prevent further movement of the device outside of this operational range.

Figure 11:
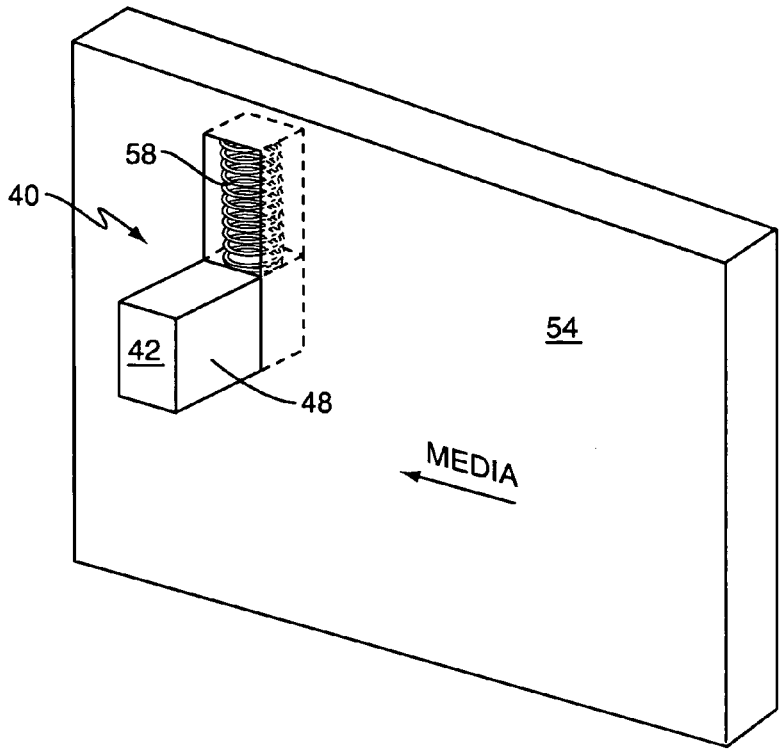
FIG. 11 is a schematic view of another exemplary media controller according to one embodiment of the present invention.

Limiter 56 may further comprise a cutout in wall 54 as illustrated in FIG. 11. In this embodiment, the cutout prevents a rigid elongated arm 42 from moving in the direction of the media insertion. As a result, blocking surface 48 prevents excess media from being inserted into the media tray 14. Further, the cutout provides a ceiling surface to mount spring 58. As a result, the arm 42 may move vertically in a similar manner as the device of FIGS. 9 and 10A–10B to allow for media expansion.

Figure 12:
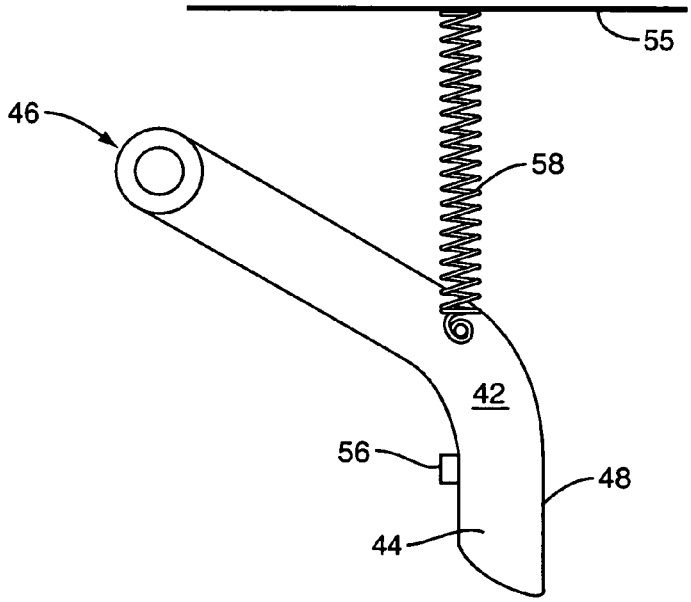
FIG. 12 is a schematic side view of another exemplary media controller according to one embodiment of the present invention.

FIG. 12 illustrates yet another embodiment of a spring-loaded stack height limiting system 40 according to the present invention. In this embodiment, the opening 52 and extension 50 in the elongated arm 42 illustrated in FIGS. 1–6 are replaced with a spring 58 and a limiter 56. As with the above-described embodiments, the limiter 56 keeps the elongated arm 42 in the limiting position such that blocking surface 48 prevents excess media from being inserted into the media tray 14. As such, blocking surface 48 prevents any media above the predetermined insertion height from being inserted into the media tray 14. Further, as the media disposed in the media tray 14 expands beyond the predetermined insertion height, spring 58 compresses, enabling the striking end 44 to move upwardly with the media.

Figure 13:
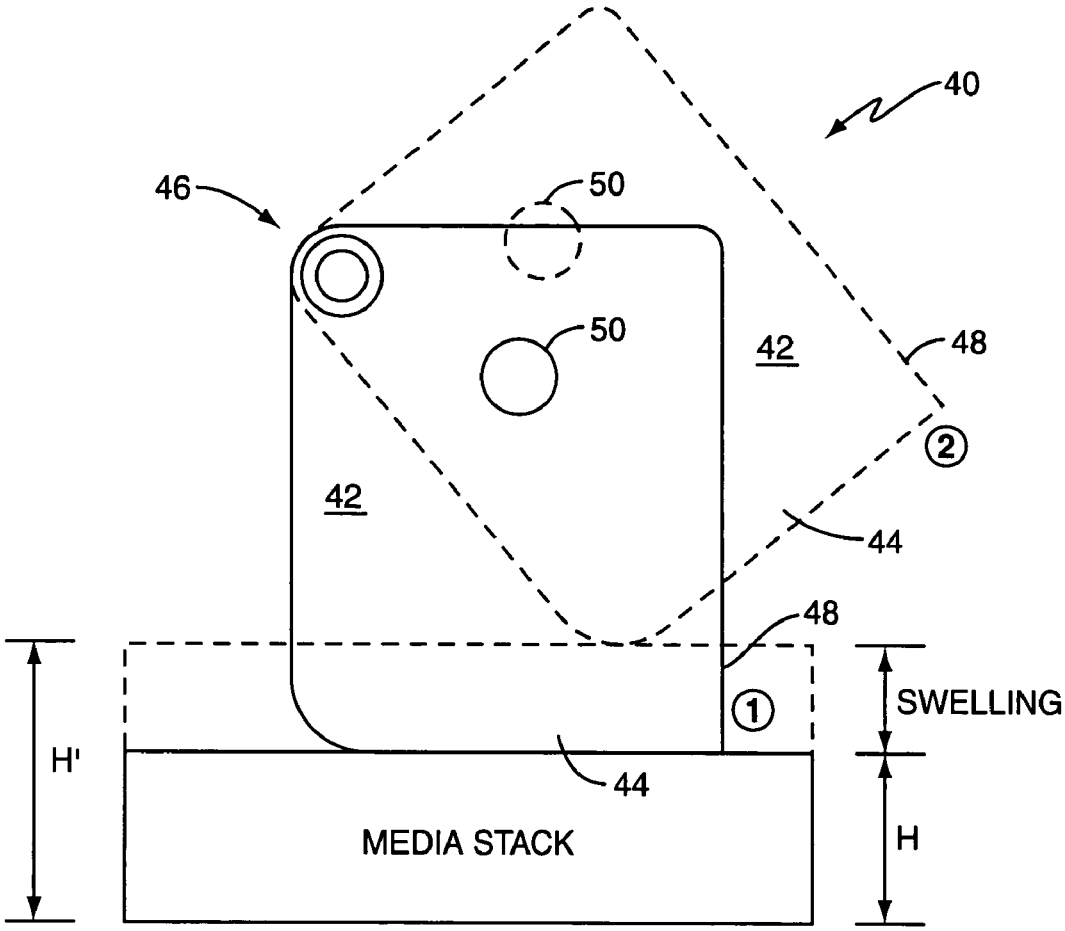
FIG. 13 is a schematic side view of another exemplary media controller according to one embodiment of the present invention.

FIG. 13 illustrates yet another embodiment of a movable stack height limiting system 40 according to the present invention. In this embodiment, the arm 42 comprises a generally rectangular block with a striking end 44 having a blocking surface 48, a control end 46, and an extension 50 extending from the arm 42 and disposed between the striking end 44 and the control end 46. As with the embodiments described above with reference to FIGS. 2–7, extension 50 keeps arm 42 in a limiting position such that blocking surface 48 prevents excess media from being inserted into the media tray 14. As the media disposed in tray 14 expands beyond a predetermined insertion height H, arm 42 rotates about control end 46 to enable the arm to move between the limiting position (position 1) and an expansion position (position 2).

It will be appreciated that when the media tray 14 is inserted into image forming apparatus 10, the striking end 44 of arm 42 is spaced from the bottom of the media tray 14 by a gap defined by the predetermined insertion height. As media disposed in the media tray 14 expands beyond the predetermined insertion height, the arm 42 moves upwardly, which increases the gap between the bottom of the media tray 14 and the striking end 44. However, when the media height decreases to a height less than the predetermined insertion height, the arm 42 maintains the first gap spacing, and therefore, separates from the media stack.

The stack height limiting system 40 described herein moves as media disposed in the tray 14 expands to prevent pinch points between the media and the stack height limiting system 40. However, the present invention may also be implemented using a stack height limiting system 40 having an arm 42 that moves away from the limiting position and into a second position when the media tray 14 is inserted into the inner cavity 18. For example, the arm 42 may rotate away from the media responsive to the media tray being inserted into the input cavity. In this embodiment, the arm 42 in the second position is separated from the media, where the second position may be in an inner section of the main body 12 or in an unused portion of the media tray 14. In so doing, the arm 42 moves completely out of the way of the media and the media path while the tray resides in the inner cavity 18. In this embodiment, arm 42 stays in the second position as long as the media tray 14 resides in input cavity 18.

The above describes a movable stack height limiter for limiting the height of media inserted into an image forming apparatus 10 while also allowing for the inserted media to expand due to changing environmental conditions. While several different exemplary embodiments of the present invention are described herein, the present invention may be carried out in other specific ways than those set forth herein without departing from the scope and essential characteristics of the invention. While not explicitly shown, in the embodiments illustrated in FIGS. 2, 3A–B, 4–5, and 6A–6B the arm 42 may be biased towards the first position by a biasing mechanism, such as a spring, instead of being configured with a center of gravity that biases the arm 42 towards the first position. The present embodiments are, therefore, to be considered in all respects as illustrative and not restrictive, and all changes coming within the meaning and equivalency range of the appended claims are intended to be embraced therein.

What is claimed is:

1. A device to control media inserted into an image forming apparatus comprising:

an elongated arm having a first end spaced from a second end, the arm movable between first and second positions; and a limiter positioned relative to the arm to define the first position, the first position oriented at a predefined insertion height above a support surface to prevent insertion of excess media beyond the predefined insertion height into the image forming apparatus;

the limiter positioned at a second height in the second position that is positioned a greater distance above the support surface than the insertion height at the first position.

2. The device of claim 1 wherein when the arm is oriented in the first position, the first end of the arm includes a substantially vertical surface that faces towards an insertion point of the media.

3. The device of claim 1 wherein the limiter comprises a rod that is movably positioned within an opening, the opening defined between a first edge and a second edge with the rod contacting the first edge when the arm is in the first position.

4. The device of claim 3 wherein the opening is disposed in the arm.

5. The device of claim 3 wherein the opening is external from the arm, and wherein the rod extends from the arm and into the opening.

6. The device of claim 1 wherein the second end of the arm comprises a pivot point, and wherein the arm moves between the first and second positions by rotating about the pivot point.

7. The device of claim 6 further comprising a center of gravity positioned relative to the arm such that the arm is configured to move towards the first position.

8. A device to control media inserted into a tray within an image forming apparatus comprising:

an elongated arm having a first end spaced from a second end, the arm movable between first and second positions; and a first gap formed between a bottom surface of the tray and the first end when the arm is in the first position, and a larger second gap formed between the bottom surface of the tray and the first end when the arm is in the second position, the first gap defining a maximum media insertion height.

9. The device of claim 8 wherein when the arm is oriented in the first position, the first end of the arm includes a substantially vertical surface relative to the bottom surface of the tray.

10. The device of claim 8 further comprising a limiter positioned relative to the arm to define at least one of a boundary of the first position and a boundary of the second position.

11. The device of claim 8 wherein the bottom surface of the tray is stationary.

12. A media input device for an image forming apparatus comprising:

a tray having a bottom surface to hold media;

a controller movable between first and second positions relative to the bottom surface of the tray; and a limiter extending outward from the controller and disposed within an opening, the opening defining boundaries of the first and second positions, the first position spaced a fixed distance from the bottom surface of the tray to define a maximum media insertion height and the second position being spaced at greater distance from the bottom surface of the tray.

13. The device of claim 12 wherein the controller has a first end spaced from a second end, a portion of the first end being at a predetermined angle relative to the bottom surface of the tray when the controller is in the first position.

14. The device of claim 13 wherein the predetermined angle comprises a substantially perpendicular angle.

15. The device of claim 12, wherein the controller is configured such that it is predisposed to move towards the first position.

16. The device of claim 12, wherein the controller is pivotally mounted about a pivot point and the opening has a curved configuration to accommodate the movement of the limiter about the pivot point.

17. The device of claim 16, wherein the controller has an elongated shape and the limiter is positioned on the controller closer to the pivot point than to the first end.

18. The device of claim 12 wherein the bottom surface of the tray is stationary.

19. A device to control media for an image forming apparatus comprising:

a tray having a bottom surface to hold the media;

an elongated arm having a striking surface that is movably mounted between a first position and a second position;

an extension extending outward from the elongated arm; and an opening positioned to receive the extension and defined by first and second boundaries, the arm movable between a first position with the extension contacting the first boundary to form a first gap between the striking surface and the bottom surface with the striking surface positioned at a predetermined angle relative to the bottom surface of the tray, and a second position with the extension spaced from the first boundary to form a second larger gap between the striking surface and the bottom surface;

the first gap defining a maximum media insertion height.

20. The device of claim 19 wherein the arm is pivotally mounted about a pivot point positioned opposite from the striking surface.

21. The device of claim 20 wherein the pivot point is positioned above the first end of the opening.

22. The device of claim 19 wherein the arm is mounted to the tray.

23. The device of claim 19 wherein the striking surface is substantially perpendicular to the bottom surface of the tray.

24. A method of controlling media within an input tray of an image forming apparatus, the method comprising the steps of:

inserting a first volume of media into the tray;

preventing insertion of additional media beyond a second volume that is greater than or equal to the first volume by using a controller oriented in a first position; and moving the controller to a second position by expanding the media disposed in the tray beyond the second volume.

25. The method of claim 24 further comprising limiting the separation between the first and second positions to prevent the media from expanding beyond a predetermined third volume, greater than the second volume.

26. The method of claim 24 wherein moving the controller to the second position comprises pushing on a first end of the controller with the expanding media to rotate the controller about a second end.

27. The method of claim 24 wherein moving the controller to the second position comprises pushing on the first end of the controller with the expanding media to compress a spring secured to a second end of the controller.

28. The method of claim 24 wherein preventing insertion of additional media beyond the second volume comprises blocking the additional media by positioning a striking surface of the controller at a predetermined angle relative to a bottom surface of the tray when the controller is in the first position.

29. The method of claim 28 wherein positioning the striking surface of the controller at the predetermined angle relative to the bottom surface of the tray when the controller is in the first position comprises positioning the striking surface of the controller in a substantially vertical position relative to the bottom surface of the tray when the controller is in the first position.

30. The method of claim 24 further comprising moving the controller towards the first position as the media compresses from the second volume towards the first volume.

31. The method of claim 24 further comprising maintaining the controller in the first position as the volume of the media compresses below the first volume.

32. A method of controlling media within an input tray of an image forming device, the method comprising the steps of:

positioning a controller having an elongated shape with first and second ends in a first position such that a distance between the first end and a bottom surface of the tray defines a first gap;

inserting media having a first height less than or equal to the first gap into the tray;

preventing insertion of media beyond the first gap by blocking media having a height greater than the first gap with the first end of the controller; and moving the controller to a second position when the media disposed in the tray expands beyond the first gap due to environmental conditions such that the distance between the first end and the bottom surface of the tray defines a second gap larger than the first gap.

33. The method of claim 32 further comprising maintaining the controller in the first position when the media height is less than the first gap.

34. The method of claim 32 further comprising contacting the media with the first end of the controller when the media height meets or exceeds the first gap.

35. An image forming apparatus comprising:

a tray having a bottom surface to hold media;

a controller movable between a first position and a second position, the controller having a first end spaced from a second end; and a limiter extending outward from the controller and disposed within an opening, the opening defining a boundary of the first position such that while in the first position the controller forms a first gap between the first end and the bottom surface of the tray during insertion of the media to prevent insertion of excess media beyond the first gap;

wherein the controller moves to the second position when the tray is disposed within the image forming apparatus and forms a second gap between the first end and a top of the media.

36. A method of controlling media within an input tray of an image forming apparatus, the method comprising:

preventing insertion of media beyond a predetermined volume into the tray by using a controller oriented in a first position; and moving the controller to a second position by inserting the tray into the image forming apparatus, the second position spacing the controller from the media such that the second position allows a volume of media within the tray greater than the predetermined volume.

37. The method of claim 36 further comprising inserting the predetermined volume of media into the tray before said moving the controller to the second position by inserting the tray into the image forming apparatus.

* * * * *